United States Patent [19]

Adamoli et al.

[11] 4,407,591

[45] Oct. 4, 1983

[54] BALLISTIC WIRE MATRIX PRINT HEAD

[75] Inventors: Contardo Adamoli, Castellamonte; Francesco Bernardis, Chiaverano; Franco Cretaz, Pont St. Martin; Mario Gaiardo, Ivrea, all of Italy

[73] Assignee: Ing. C. Olivetti & C., S.p.A., Italy

[21] Appl. No.: 292,173

[22] Filed: Aug. 12, 1981

[30] Foreign Application Priority Data

Aug. 21, 1980 [IT] Italy ..... 68304 A/80

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,770,092 | 11/1973 | Grim | 400/124 |
| 3,896,918 | 7/1975 | Schneider | 400/124 |
| 3,929,214 | 12/1975 | Hebert | 400/124 |
| 4,004,673 | 1/1977 | Burzlaff et al. | 400/124 |
| 4,049,107 | 9/1977 | Murat | 400/124 |
| 4,165,940 | 8/1979 | Cacciola | 400/124 |

*Primary Examiner*—Paul T. Sewell

*Attorney, Agent, or Firm*—Schuyler, Banner, Birch, McKie & Beckett

[57] ABSTRACT

A wire printing head of ballistic type comprises a front guide fixed to a carriage and in which the printing wires are mounted in an axially slidable manner. The electromagnets for actuating the wires have their respective cores mounted inside a tube of non-magnetic material. In order to obtain high heat dissipation, the electromagnet cores and windings are embedded in a resin block which fills the interior of the tube. The exterior of the tube is also provided with a set of cooling fins.

The electromagnet armatures are mounted on a rear cover which is connected by a screw to a part of the front guide, which in its turn is housed in a compartment in the resin block. Shims are disposed between the front guide and group of electromagnets, and their number can be varied in order to modify the distance of the ends of the printing wires from the platen.

4 Claims, 3 Drawing Figures

BALLISTIC WIRE MATRIX PRINT HEAD

BACKGROUND OF THE INVENTION

This invention relates to a wire printing head of ballistic type, comprising a plurality of wires slidable axially in a guide, and which are projected by the armatures of a corresponding plurality of control electromagnets in order to effect printing.

A head of this type is known in which a group of seven or nine electromagnets is supported by a semicircular metal plate disposed transversely to the printing wires. A resin block fixes the individual cores and the energising coils to the baseplate. Most of the radiating surface is therefore in resin, and this leads to considerable temperature rises in the most inner parts of the energising coils, especially when the number of electromagnets and/or their frequency of energisation are to be increased. This represents a serious limit to high speed printing.

SUMMARY OF THE INVENTION

The object of the invention is to provide a printing head which has a very compact structure while at the same time succeeding in properly dissipating the heat produced by the energisation of the coils of the electromagnets which control the wires.

The printing head according to the invention comprises a supporting guide, a plurality of wires axially slidable in said guide, a corresponding plurality of control electromagnets having each one an armature connected to a corresponding wire, for the actuation thereof, and a tube of high thermal conductivity material having an inner wall, said electromagnets having magnetic cores spaced around and in contact with said inner wall of said tube.

BRIEF DESCRIPTION OF THE DRAWINGS

The invention will be described in more detail, by way of example, with reference to the accompanying drawings, in which.

DETAILED DESCRIPTION OF A PREFERRED EMBODIMENT

Figure 1:
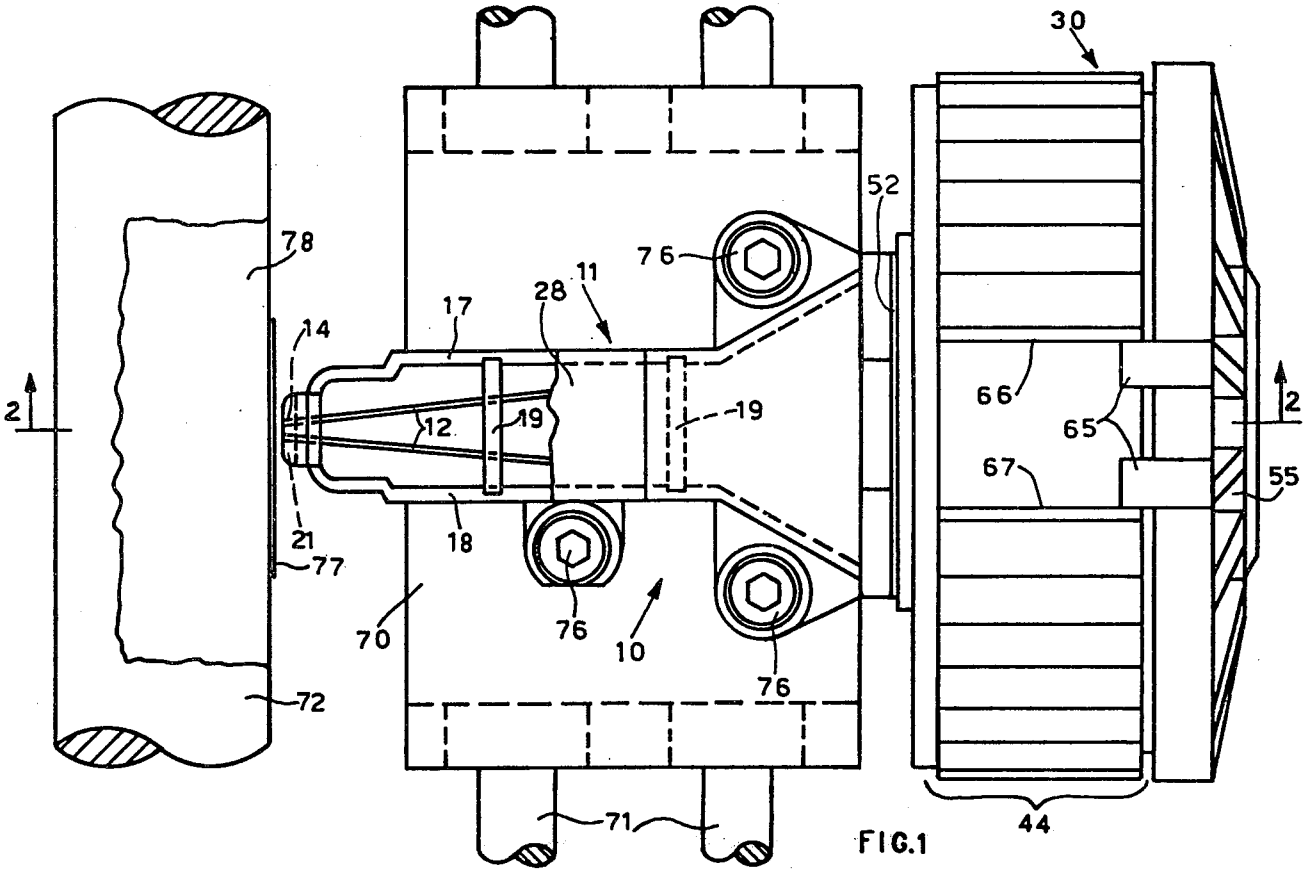
FIG. 1 is a plan view of a wire printing head embodying the invention.
Figure 2:
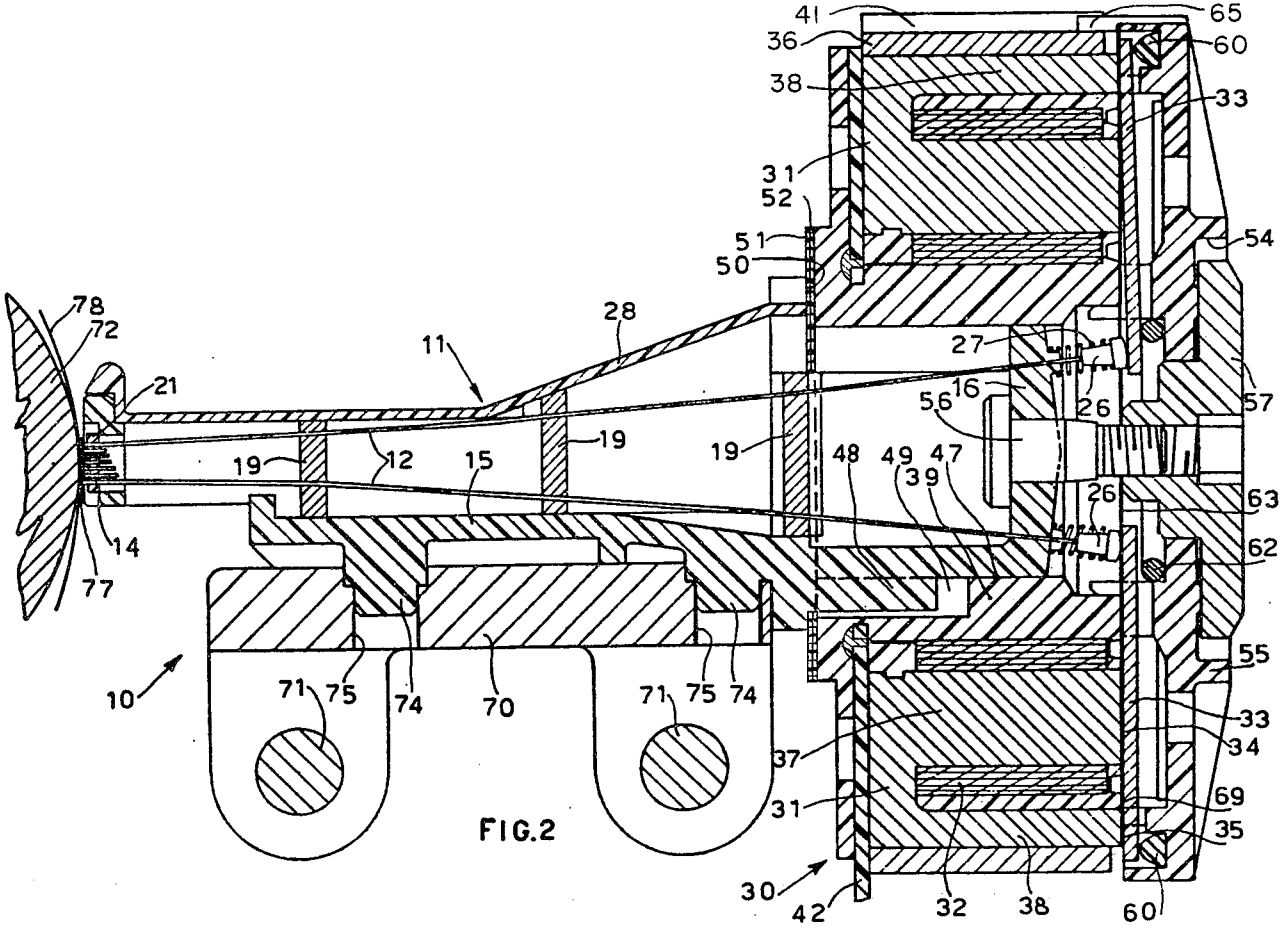
FIG. 2 is a section on the line 2—2 of FIG. 1.

With reference to FIG. 1, the printing head 10 comprises a front guide 11 of plastics material, inside which a plurality of metal printing wires 12 is mounted in an axially slidable manner (see also FIG. 2). In the particular embodiment described herein, the wires are sixteen in number, and have their front printing ends 14 aligned in two parallel columns, which are offset from each other by one half of the wire-to-wire pitch, to provide high definition dot printing. In a simplified version, not described herein, the printing wires can be seven or nine in number, and in this case have their printing ends aligned in a single column.

The guide 11 is shaped to comprise a base wall 15, a rear wall 16 and two side walls 17 and 18, between which are disposed transverse plates 19 provided with through bores, which guide the wires 12 by preventing them from moving laterally. The printing ends 14 of the wires 12 are guided by a perforated plate 21 disposed on the front end of the guide 11. At their rear, each wire 12 (FIG. 2) is guided by said wall 16, and has its rear end rigidly connected to a head 26 of plastics material, with which there cooperates a spiral spring 27 which, when at rest, retains the corresponding wire 12 in an inoperative, withdrawn position. A cover 28 is removably mounted on the guide 11.

Figure 3:
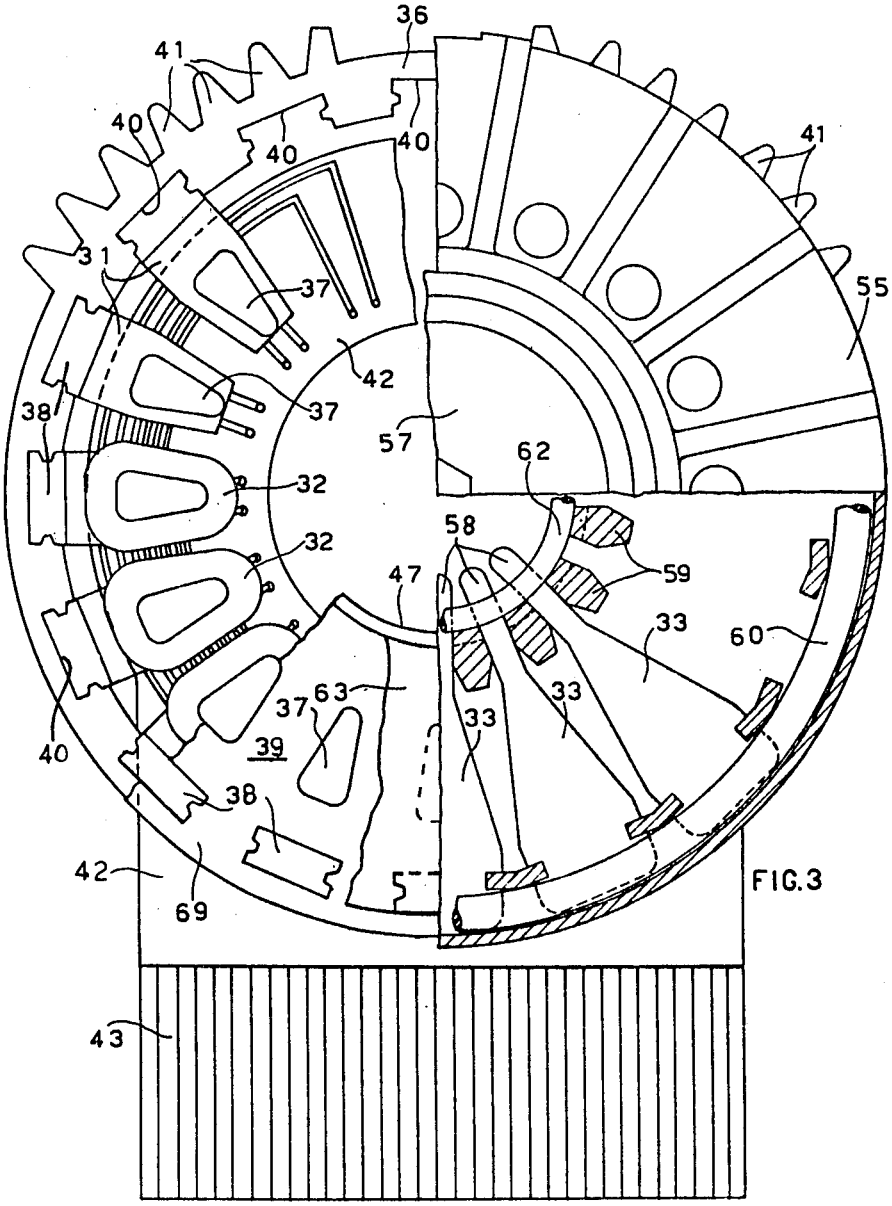
FIG. 3 is a partly sectional rear view of the printing head.

A plurality of operating electromagnets 30 associated with the wires 12 is mounted to the rear of the guide 11. In particular, each electromagnet 30 comprises a core 31 of ferromagnetic material shaped in the form of a U and provided with a leg 37 (FIGS. 2 and 3) of triangular cross-section and a leg 38 of rectangular cross-section, an energising coil 32 wound about the leg 37, and an armature 33 facing the pole faces 34 and 35 of the legs 37 and 38. The cores 31 are produced for example by sintering ferromagnetic powders, this enabling the shape heretofore described to be obtained at low cost. The cores 31 and coils 32 of all sixteen electromagnets 30 (FIG. 3) are spaced around the inside a tube 36 of a non-magnetic material having high thermal conductivity, for example sintered aluminium, and are embedded in a single resin block 39 which adheres to the interior of the tube 36.

The tube 36 is shaped in such a matter as to possess internal axial seats 40 equidistant angularly from each other, into which the legs 38 of the cores 31 are fitted, and to comprise external radial fins 41 for better dissipation of the heat developed by the electromagnets 30 during the operation of the head 10.

A printed circuit 42 containing the supply strips for the coils 32 is also embedded in the resin block 39, and its lower part 43, which comprises the terminals of the supply strips, is arranged for connection to an edge connector.

The resin block 39, the aluminium tube 36, the printed circuit 42, the cores 31 and coils 32 constitute a single homogeneous unit 44 (FIG. 1) which can be preassembled in the manner described in detail hereinafter.

The resin block 39 (FIG. 2) has a central through bore 47 in which the rear end of the guide 11 is housed. In order to prevent relative rotation between the unit 14 and the guide 11, this latter is provided with a lower key 48 housed in a corresponding slot 49 in the block 39. The position of the guide 11 in the axial direction relative to the unit 44 is determined by a transverse shoulder 50 of the guide 11, which is arranged to abut against a front wall 51 of the resin block 39, by way of one or more removable shim discs 52, each having a predetermined thickness, for example one hundredth of a millimeter.

The armatures 33 of all the sixteen electromagnets 30 are arranged, angularly equidistant from each other, inside a single rear plastics support 55, which is of substantially cylindrical shape and has its base 54 connected to the guide 11 by means of a screw 56 and a capping nut 57.

Each armature 33 has an inner end 58 (FIG. 3) which is tapered and guided between two elements 59 of the support 55. Each end 58 is constantly in contact with a corresponding head 26 of a printing wire 12.

When the electromagnets 30 are not energised, the armatures 33 are kept inclined to the pole surfaces 34 and 35 of the cores 31 by the action of the spiral springs 27. A ring 60 of resilient material, mounted on the support 55 in proximity to its periphery, keeps all the armatures 33 in contact with the corresponding magnetic cores 31 and, more particularly, against the pole surfaces 35 of the arms 38.

When in the rest state, under the action of the springs 27 on the heads 26, the armatures 33 all rest against a second ring 62 of resilient material which is mounted on the support 55 in a position corresponding with the inner ends 58 of said armatures 33.

A disc 63 of plastics material, for example Mylar (Trade Mark), having a thickness of a few hundredths of a millimeter, is disposed between the magnetic cores 31 and armatures 33, and always rests against the pole faces 34 and 35 to precisely define the minimum gap between the armatures and cores.

The rear support 55 has two fins 65 (FIG. 1) inserted between two shoulders 66 and 67 of the aluminium tube 36, in order to angularly position said support 55 relative to the unit 44, and prevent relative rotation between these two latter.

The previously described unit 44 is assembled in the following manner. The printed circuit 42 (FIGS. 2 and 3) is fixed to the front end of the aluminium tube 36 in any known manner, for example by screws not shown on the drawings. The legs 38 of the magnetic cores 31 (FIG. 3) are then inserted into the respective seats 40.

An energising coil 32 is then inserted over each inner pole piece or leg 37 of the cores 31, and its ends are soldered to the underlying conducting strips of the printed circuit 42. The elements associated in this manner are finally embedded in the insulating resin forming the block 39, which is then further machines in order to assume the described shape shown on the drawings. In particular, a frontal rear surface 69 opposite the front wall 51 is ground such that all the pole faces 34 and 35 lie in a single plane perpendicular to the axis of the tube 36, and without any projections. This means that the disc 63, which is disposed between the cores 31 and armatures 33, lies in a single plane and has no preferential zones of drawing, and thus of fracturing. The bore 47 is also ground in order to guide the front guide 11 with precision.

The printing head 10 described heretofore is arranged for mounting on a carriage 70 (FIGS. 1 and 2) of a serial printer of known type, for example of the type described in our U.S. patent application Ser. No. 06/267,911 filed on May 28, 1981 and assigned to the same assignee as the present application. The carriage 70 can be constructed of plastics material, and is slidable on guides 71 parallel to a platen 72. For correct positioning of the head 10 on the carriage 70, the base wall 15 of the guide 11 is provided with two cylindrical pins 74 to be inserted into corresponding bores 75 in the carriage 70. Three screws 76 are provided for removably fixing on to the carriage 70 the head 10 positioned by the pins.

The operation of the printing head 10 according to the invention takes place in known manner by moving the carriage 70 parallel to the platen 72 and selectively actuating the electromagnets 30 which cause the wires 12 to transfer ink from a ribbon 77, disposed between the printing ends 14 of the wires 12 and platen 72, on to a sheet 78 carried by the platen 72. More precisely, each time one of the coils 32 is fed with current, a magnetic flux is generated in the core 31, which causes the corresponding armature 33 to be attracted towards the pole faces 34 and 35. This leads to the axial movement of the wire 12 associated therewith, and this continues its path of travel towards the platen 72 ballistically, even after the armature 33 has been halted against the disc 63 disposed between it and the core 31. After a dot has been printed on the sheet 78, the reaction force causes the wire 12 to return towards its rest position. As the coil 32 was de-energized at the moment in which the armature 33 reached the disc 63, the spring 27 returns the wire 12 and armature 33 to rest, against the resilient ring 62.

In the printing head 10 embodying the invention, it is possible to vary the distance of all sixteen wires 12 from the platen 72 without removing the head from the carriage 70. In this respect, if the number of spacer discs 52 disposed between the unit 44 and front guide 11 is increased or decreased, the distance of the wires 12 from the platen 72 is respectively increased or decreased, while maintaining the conditions between the wires 12 and actuating electromagnets 30 unchanged.

The fact that all the magnetic cores 31 are mounted on the tube 36 with their respective metal surfaces in direct contact, coupled with the fact that a resin filling is present, means that heat transfer is made easy and the tube acts as an effective dissipater of the heat produced by the flow of current through the energising coils 32. Moreover, the presence of the radial fins 41 improves heat transfer between the head and the exterior. From the point of view of dissipation of the heat produced by the energisation of the coils 32, the unit 44 is completely self-sufficient, and its temperature rises above ambient is very low. This means that the head according to the invention can also be mounted on plastics carriages without any danger of these becoming damaged because of the heat developed during operation.

What we claim is:

1. A ballistic wire matrix print head comprising a guide assembly, a plurality of printing wires axially slideable in said guide assembly, a plurality of electromagnetic structures, each including a U-shaped core of ferromagnetic material provided with an outer pole piece and an inner pole piece, and an energizeable coil wound on said inner pole piece, means for supporting said electromagnetic structures and for dissipating the heat produced by the energization of said coils, said supporting and heat dissipating means comprising a cylindrical tube of a non-magnetic material having a plurality of internal axial seats radially disposed, into each of which is fitted one of said outer pole pieces, means for mounting said tube coaxially with respect to said guide assembly, said mounting means comprising a resin block which embeds said cores and said coils internally to said tube, and which is provided with a central through hole for housinga rear part of said guide assembly, a plurality of armatures disposed radially with respect to said guide assembly and associated with said electromagnetic structures to form electromagnetic actuators for transferring electromechanical energy to said printing wires, and an armature retainer coupled to said guide assembly for maintaining each armature in engagement with its associated pole pieces and with its corresponding printing wire.

2. A ballistic wire matrix print head comprising a guide assembly, a plurality of print wires axially slideable in said guide assembly, a corresponding plurality of electromagnets for selectively actuating said printing wires, said electromagnets being disposed radially about said guide assembly, each one of said electromagnets comprising a core of ferromagnetic material shaped in the form of a U and provided with an inner pole piece of substantially triangular cross-section, and an outer pole piece of substantially rectangular cross-section, an energizeable coil wound on said inner pole piece and an armature associated with said two pole pieces, and to one corresponding wire of said wires for the actuation thereof, means for supporting said cores and for dissipating the heat produced by the energization of said coils, said supporting and heat dissipating means comprising a cylindrical tube of a non-magnetic material having a plurality of internal axial seats of substantially rectangular cross-section disposed radially with respect to said guide assembly and closely therebetween, each one of said outer pole pieces being fitted into one of said axial seats in a manner such that the inner pole pieces of said cores are disposed radially with respect to said guide assembly and closely therebetween, and means for mounting said tube substantially coaxial to said guide assembly, said mounting means comprising a resin block which embeds said cores and said coils internally to said tube, and which is provided with a central through hole for housing a rear part of said guide assembly.

3. A ballistic wire matrix print head according to claim 2, wherein said cylindrical tube comprises a plurality of radial external fins to promote heat dissipation.

4. A ballistic wire matrix print head comprising an elongated guide assembly; a plurality of printing wires axially slideable in said guide assembly; a corresponding plurality of electromagnetic structures, each including a U-shaped core of ferromagnetic material provided with an outer pole piece of substantially rectangular cross-section and an inner pole piece of substantially triangular cross-section, and an energizeable coil wound on said inner pole piece; means for supporting said electromagnetic structures and for dissipating the heat produced by the energization of said coils, said supporting and dissipating means comprising a cylindrical tube of a non-magnetic material having a plurality of axial seats radially disposed around the internal surface of said tube, into each of which is fitted one of said outer pole pieces of said plurality of electromagnetic structures in a manner such that said inner pole pieces are radially disposed inside said cylindrical tube closely therebetween; means for mounting said tube coaxially with respect to said elongated guide assembly, said mounting means comprising a resin block which embeds said cores and said coils internally to said tube, and which is provided with a central through hole for housing a rear end of said elongated guide assembly; a plurality of armatures disposed radially with respect to said elongated guide assembly and associated with said electromagnetic structures to form electromagnetic actuators for transferring electromechanical energy to said printing wires; and an armature retainer coupled to said elongated guide assembly for maintaining each armature in engagement with its associated pole pieces and with its corresponding printing wire.

* * * * *